US006045128A

United States Patent [19]

Hunt

[11] Patent Number: 6,045,128

[45] Date of Patent: Apr. 4, 2000

[54] METHOD AND APPARATUS FOR AN EDUCATIONAL BOARD GAME

[76] Inventor: Sharon Kaye Hunt, 118 Villa North Coutr, Warner Robins, Ga. 31093

[21] Appl. No.: 09/259,023

[22] Filed: Feb. 26, 1999

[51] Int. Cl.[7] ..... A63F 3/00

[52] U.S. Cl. ..... 273/236; 434/128

[58] Field of Search ..... 273/236, 242, 273/243, 281, 283; 434/128, 130

[56] References Cited

U.S. PATENT DOCUMENTS

| | | | |
|---|---|---|---|
| 523,338 | 7/1894 | Fearn . | |
| 2,319,045 | 5/1943 | Di Lemme . | |
| 3,711,966 | 1/1973 | Drcsak | 273/242 |
| 3,721,443 | 3/1973 | Napoli | 273/236 |
| 3,936,054 | 2/1976 | Garcia | 273/236 |
| 4,029,321 | 6/1977 | Lang, Jr. | 273/243 |
| 4,326,711 | 4/1982 | Giallombardo . | |
| 4,807,878 | 2/1989 | Tripp . | |
| 4,953,869 | 9/1990 | Muhammad | 273/236 |
| 5,002,282 | 3/1991 | Hanley | 273/236 |
| 5,244,391 | 9/1993 | Bryant | 434/128 |
| 5,332,227 | 7/1994 | Passero . | |
| 5,362,061 | 11/1994 | Napolitano | 273/243 |
| 5,553,853 | 9/1996 | Sackitey | 273/236 |
| 5,580,252 | 12/1996 | McCrady . | |
| 5,749,579 | 5/1998 | Piacentino | 273/243 |
| 5,816,819 | 10/1998 | Rockburn | 273/236 |

*Primary Examiner*—Sam Rimell
*Attorney, Agent, or Firm*—Richard C. McComas

[57] ABSTRACT

The invention is an educational board game and learning tool for children. The children learn selected attributes about a selected state in the United States. The educational board game has a color coordinated playing surface that is divided into five distinct major categories representing, at a macro level, the state's archives, famous people, natural history, cities and counties, and tourist attractions. The presentation of these categories at a macro level enables a child to quickly focus on one of five major categories. The invention has a state quester that when spun circumnavigates the playing surface of the invention. The state quester, after coming to rest, selects one of the five major categories that are juxtaposition the state quester. The state quester may also select one of the five award or penalty areas disposed about the playing surface. The questions asked the children or players are derived from the major categories.

7 Claims, 3 Drawing Sheets

METHOD AND APPARATUS FOR AN EDUCATIONAL BOARD GAME

FIELD OF THE INVENTION

The present invention relates to a method and an apparatus for educating children. In particular the present invention relates to a method and an apparatus for educating children about a particular state in the United States. More particularly the present invention is an educational board game that provides incentives, rewards, and penalties for answering posed questions about a particular state in the United States.

BACKGROUND OF THE INVENTION

The educational board game industry comprises a plurality of different types of games. Some games provide the players with rewards for answering questions correctly. Other types of games involve the players with the elements of chance. Still other types of games stimulate the players' minds and sharpen their skills in being prepared to answer detailed questions on a variety of topics.

Educational games may be elaborate or very simplistic in their presentation of questions and answers. An example of an elaborate educational trivia type game is one that is broadcast on television. These types of games have to some extent gained in popularity. A trivia master asks a question to a contestant and the contestant answers the question correctly or loses something of value that has been previously won by the contestant. This process continues until a given amount of things of value have been won or the allotted time for the game show has expired. On the other end of the spectrum is the flash card game. A deck of cards has one side displaying a question and the other side displaying the answer to the question. One player of the game asks a question of another player wherein that player must answer the question correctly to gain something of value. If the player answers the questions incorrectly he loses something of value. Prizes, points, and scores are generally the things of value that are awarded to the players who answer questions correctly. These items are also the things that must be given up by the players who answer questions incorrectly. The very nature of these games suggests winning or losing instead of education.

Attempts in the past have been unsuccessful in remedying the problem of providing an educational board game stimulating the players to answer questions correctly, rewarding successful players and increasing the training to the less than successful players while enhancing the education of all the players involved. One such attempt is U.S. Pat. No. 5,580,252 issued to McCrady on Dec. 3, 1996. The McCrady patent discloses a board game involving a map of one state in the United States, a die, matching player icons, and score keeping. The game also includes a compass for directing a player around the various regions of the United States in an effort to teach the player about a particular state in the United States.

The McCrady patent is an educational board game involving gamesmanship and recognition of information about a particular state in the United States. The McCrady patent does not focus on a particular state's attributes that give that state its identity, character, and history. The McCrady patent's only focus is on teaching the players about the cities and counties of the state in question. The wealth of information when presenting state attribute information is voluminous and is especially difficult for young children who may participate in the game. Young children tend to react in a negative way when presented with voluminous material in a game format. The expectation is they should know all of the material presented rather than only a given amount considering their ages and learning experience. This self imposed expectation is detrimental to the learning experience of children.

SUMMARY OF THE INVENTION

Educating children about a state in the United States is an important task. Children respond to information presented in an organized format that is not overwhelming to them. There are numerous attributes and characteristics of any given state that makes that particular state unique. The present invention combines the teaching of a state's attributes and characteristics in a format that is not overwhelming to children.

The present invention is an educational board game that is generally played by at least three players. The players assemble about a substantially circular playing surface. The playing surface is divided into five major areas with five bonus and five sky areas disposed intermediate each major area. If desired the center of the playing surface may contain a picture of the state to which the game pertains. Each of the five major categories denotes a particular state's attributes and characteristics. Within each major category there are point award areas that delineate the possible value of points that are awarded for correctly answering a posed question about a selected state's attributes and characteristics. A state quester or dial is provided to differentiate between the major categories and the bonus and sky areas. The state quester has one end rotatively disposed at the center of the top playing surface. The other end of the state quester extends to the outer periphery of the playing surface.

One of the players is selected to begin the game by ringing a bell and spinning the state quester in a clockwise or counter clockwise direction. When the state quester comes to rest, it is positioned over one of the major categories, a bonus question, or the sky area. The positional occurrence of the state quester selects the major category from which questions are drawn. The state quester also selects from which area the bonus question is drawn or the sky area in which the player loses all points accumulated thus far. All of the players assembled about the present invention attempt to ring the bell. The ringing of the bell indicates a particular player is ready to answer a question posed by a selected player or an announcer. The announcer selects a question and answer card from a deck of sixty question and answer cards. The announcer asks the player who was the first to ring the bell the question from the question and answer card. If the player answers correctly points are awarded corresponding to the category juxtaposition the state quester. If the player answers the posed question incorrectly points indicated on the playing surface juxtaposition the state quester are deducted from that player's total score.

If by chance the state quester comes to rest over a sky area the player involved loses all accumulated points. If the state quester comes to rest over a bonus position the involved player selects a point value derived from one of the five major categories. The derived point value is awarded to the player if he answers the posed question correctly and points are deducted from the player's score if the posed question is answered incorrectly.

Other features and advantages of the present invention will become apparent when taken in conjunction with the accompanying drawings and the appended claims and reading the following detailed description of embodiments of the invention.

BRIEF DESCRIPTION OF THE DRAWINGS

The invention is illustrated in the drawings in which like reference characters designate the same or similar parts throughout the figures of which.

DETAILED DESCRIPTION OF THE PREFERRED EMBODIMENT OF THE INVENTION

Figure 1:
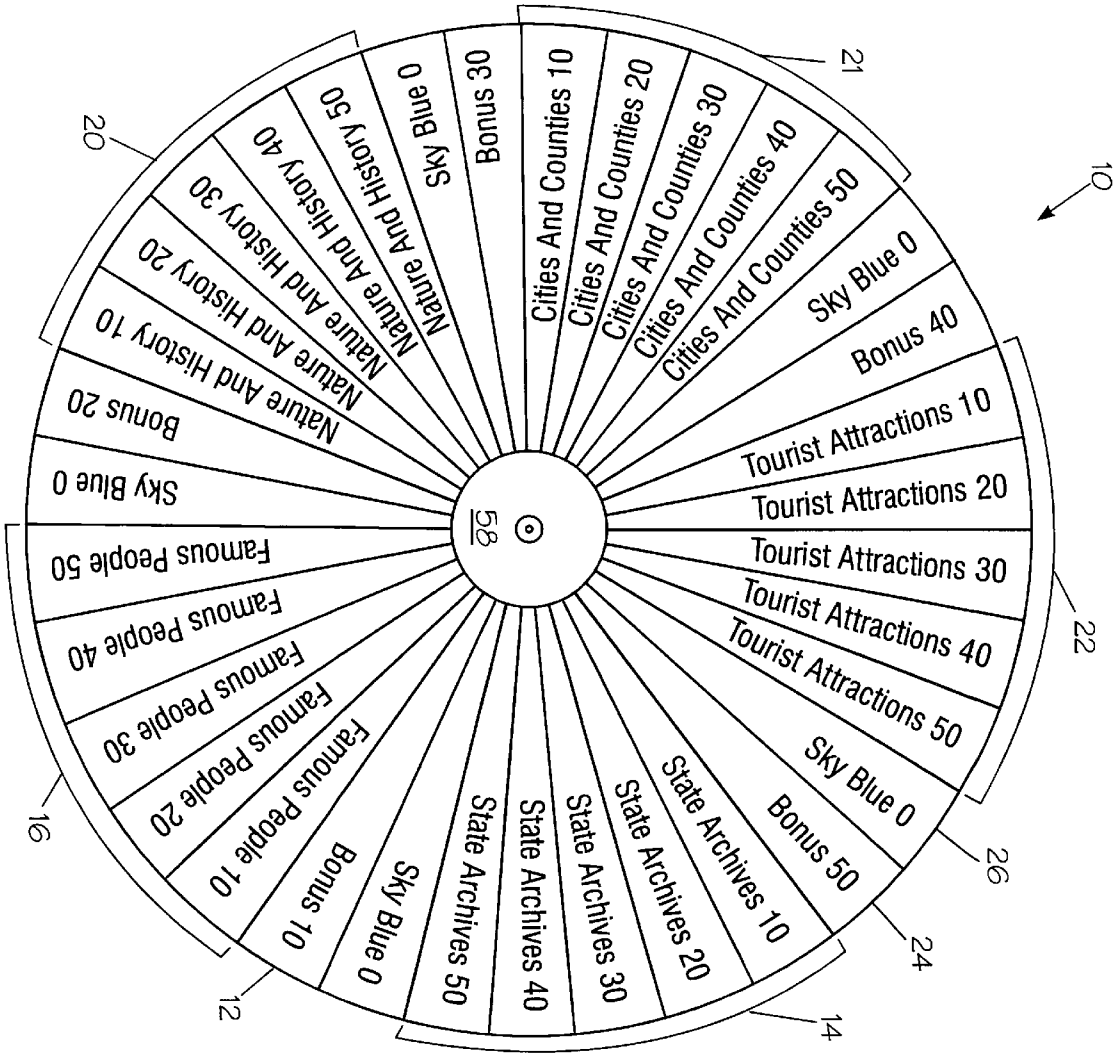
FIG. 1 illustrates a schematic view the present invention.

The present invention is an educational board game generally illustrated at 10, FIG. 1. The present invention 10 is played by children of any age preferably nine years of age and older. The present invention 10 tests the knowledge of a child pertaining to a state in the United States in which the child resides. The child may be in any state and still utilize the present invention 10 to play the game of any other state of his choosing. It is understood the present invention 10 is a universal state game. For example, the state of Georgia is featured as the game of choice of the present invention 10 regardless where the playing of the game occurs. The same is true for the state of Alabama or any other state in the United States.

Figure 2:
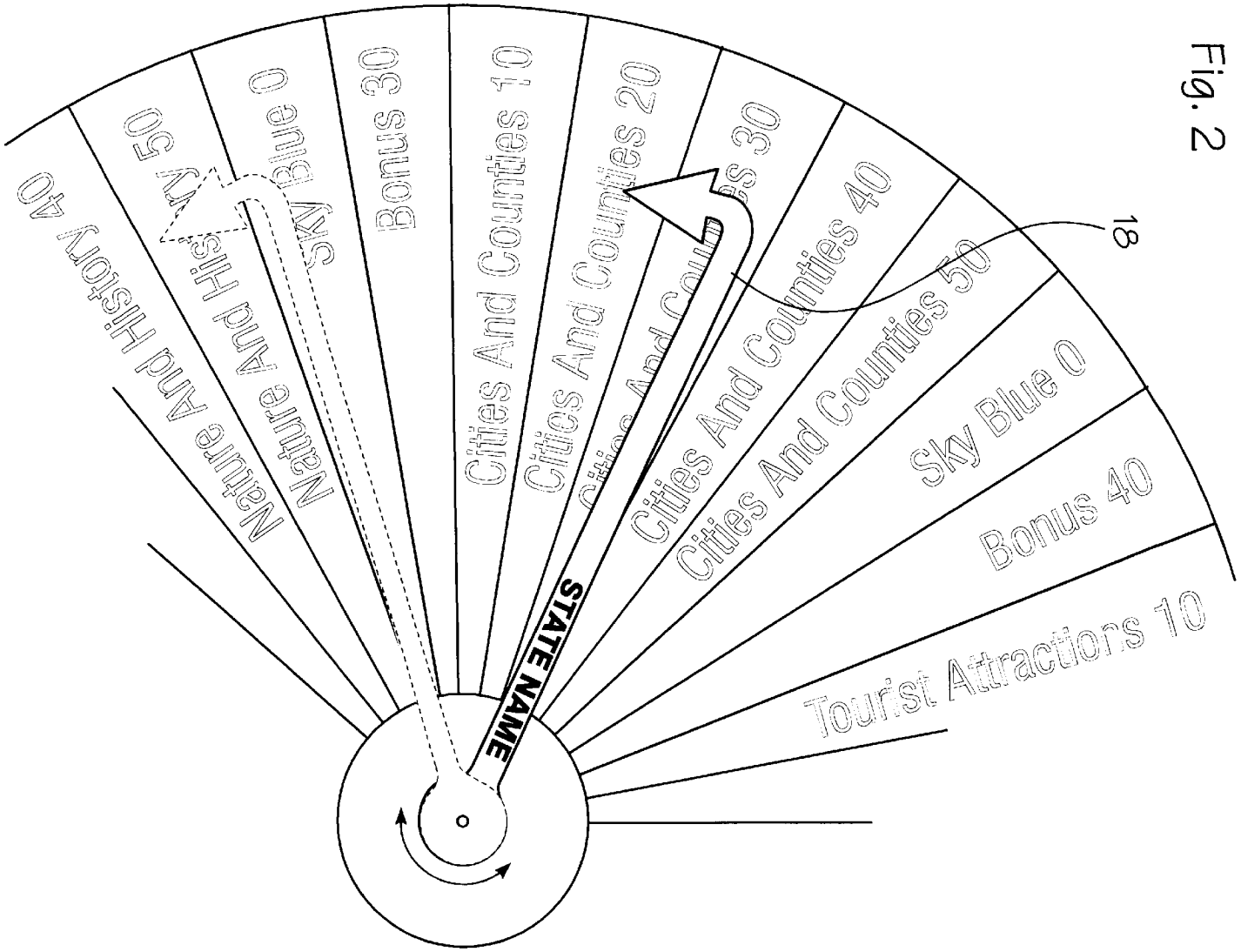
FIG. 2 illustrates a schematic view of the state quester of the present invention.

The game 10, FIG. 1, has a generally circular shape with a playing surface 12 divided into five major categories. These five major categories represent generalized areas of interest pertaining to questions that may be asked during the course of play. If desired the playing surface 12 may be divided into five distinct color coordinated categories. The color selected for a particular category is color coordinated with selected game question cards 46, FIG. 5. The color coordinating of individual categories quickly identifies that particular category to the players of the present invention 10. The major category 14 is colored coordinated with the question cards 46 and represents questions about a particular state's archives. The major category 16 is color coordinated with the question cards 46 and represents questions about a particular state's famous people. The major category 20 is color coordinated with the question cards 46 about a particular state's natural history. The major category 21 is color coordinated with the question cards 46 and represent questions about a particular state's cities and counties. The major category 22 is color coordinated with the question cards 46 and represent questions about a particular state's tourist attractions. The present invention 10 has an elongated dial or state quester 18, FIG. 2. This state quester 18 has one end affixed to the center 58 of the playing surface 12. The center 58 of the playing surface 12 may, if desired, have a picture of the state to which the game pertains. The other end of the state quester 18 extends to the outer edge of the surface 12. The state quester 18 may, if desired, be any size that will freely rotate about the center point 58 of the surface 12, FIG. 2, and allow the reading or interpretation of the five categories 14, 16, 20, 21, and 22.

Figure 3:
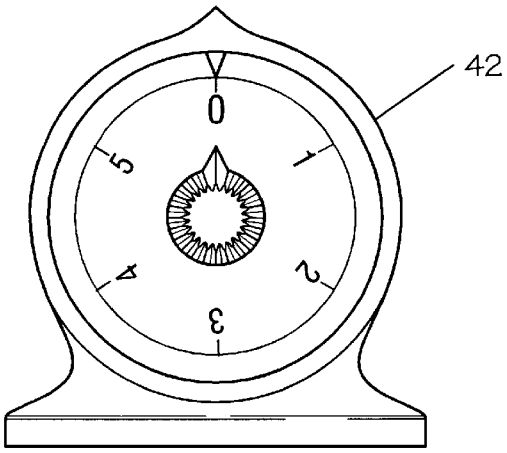
FIG. 3 illustrates a schematic view of a timer of the present invention.
Figure 4:
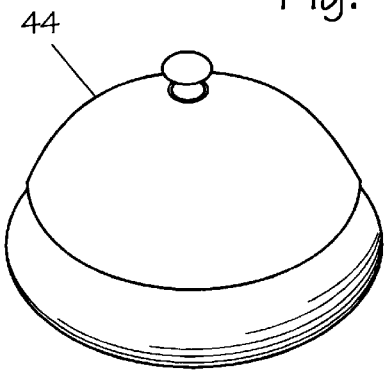
FIG. 4 illustrates a plan view of the bell of the present invention.
Figure 5:
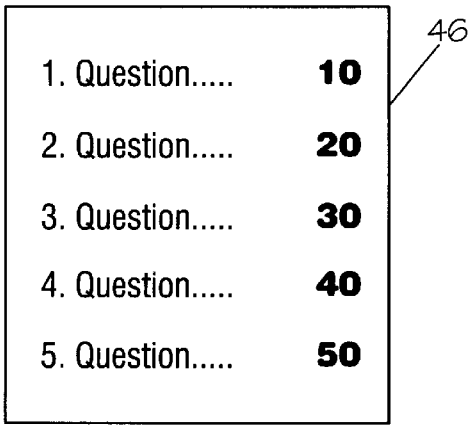
FIG. 5 illustrates a plan view of a deck of question and answer cards of the present invention.
Figure 6:
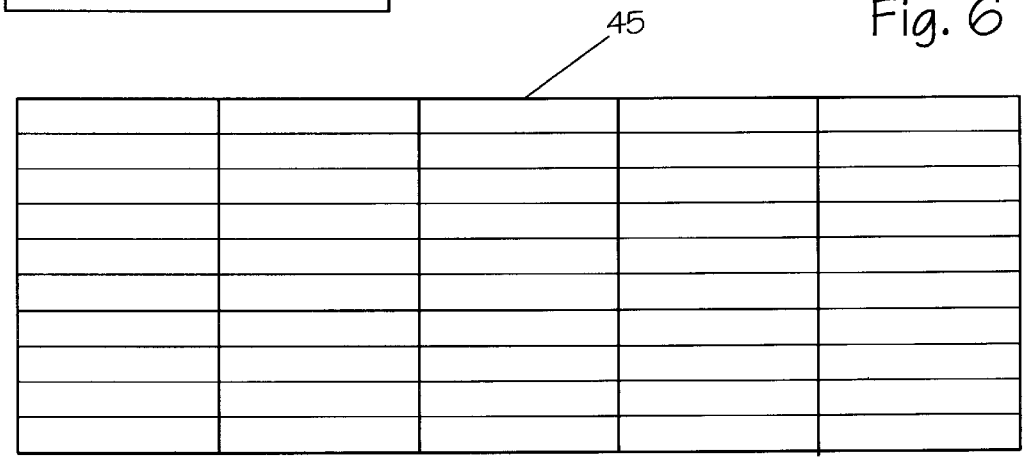
FIG. 6 illustrates a schematic view of a score sheet of the present invention.

Each of the five major categories 14, 16, 20, 21, and 22, have associated point values. For example, the major category 14, FIG. 1, state archives, has point values 10, 20, 30, 40, and 50. Each point value represents points that may be awarded to the selected player who correctly answers the state archives question posed thereto. The other four major categories have similar point values for their respective category. There are five bonus 24 and sky 26 areas that are disposed about the playing surface 12. Preferably, the bonus 24 and sky 26 areas are intermediately positioned between any two adjacent major categories. The bonus area 24 is awarded to players who have, by chance of the spin of the state quester 18, landed on the bonus area 24. The five bonus areas 24 all have different numerical values. The numerical values are 10, 20, 30, 40, and 50 points to be added to the players score if the posed question is correctly answered. The sky area 26 is a penalty area. If a player, by chance, lands on any sky area 26 he loses all accumulated points. The methodology of playing the game of the present invention 10 and the accumulation of points, penalties, and bonuses is discussed herein. An ordinary timer 42, FIG. 3, is provided to time the playing of the game of the present invention 10. The timer 42 may be any convenient time keeping mechanism that is known in the art of board games. A bell 44, FIG. 4, is provided and is rung at the beginning of the game and rung by selected players at appropriate intervals during the progress of the game of the present invention 10. A score card 45, FIG. 6, is provided to record the score to be entered by respective players during the progression of the game. Any convenient grid like form may be used that accommodates the players' names in one column and their respective scores in respective rows. A deck of sixty question and answer cards 46, FIG. 5 is provided to engage selected players in questions and answers. It is understood the deck of cards 46 contains a plurality of individual cards reflecting different categories, questions, answers, and relative point values awarded to players who successfully answer posed questions. The question cards 46 illustrates only five groupings of questions and answers but it is understood that any number of questions and answers may be disposed on the surface of the question cards 46 that is convenient for the playing of the game of the present invention 10.

The present invention 10 is primarily designed to be played by children nine years of age and older. A minimum of two players is required to participate in the playing of the game. One player may, if desired, be designated as an announcer. If desired a third player may participate in playing the game and be designated as the announcer of the game. The announcer's major function is to start and moderated the progress of the game. Once the appropriate number of players are assembled about the present invention 10, the announcer determines which player is designated as the beginning player. The announcer determines this player by mutual agreement among the players or if desired by selection through a toss of a coin. If more than two players are engaged in the game the announcer holds a drawing. The player that correctly draws the number one from a plurality of drawing numbers begins the game. The announcer sets the timer 42 for the duration of the playing period of the present invention 10. The time period may, if desired, be mutually agreed upon by all of the players or it may be set to the preferred time limit of five minutes.

The designated player begins the game by spinning state quester 18 in a clockwise direction. The state quester 18 rotates about a center point 58 of the playing surface 12. Frictional forces involved in spinning of the state quester 18 about the center point 58 gradually cause the state quester 18 to stop spinning. The state quester 18 comes rest with the body of the state quester 18 extending over one of the major categories 14, 16, 20, 21, 22, or over one of the bonus or sky areas. The state quester 18, by coming to rest over one of the major categories 14, 16, 20, 21, or 22 selects a particular major category as the category of questions and answers for one of the players.

The moment the state quester 18 comes to rest any of the players may attempt to be the first to ring the bell 44 indicating they are prepared to answer the question posed in the selected categories 14, 16, 20, 21, or 22. In the case of multiple players attempting to or actually ringing the bell 44 simultaneously, the announcer decides which player was the first to ring the bell 44.

The announcer now selects a question and answer card from the question cards 46. The question and answer card selected is relevant to the selected major category indicated by the state quester 18. The announcer poses the question to the player. If the player answers the question correctly the player receives a positive score to be added to the player's score sheet 45. In the event the player does not answer the question correctly a negative score is added to the player's score sheet resulting in a point deduction of the player's total score.

The scores the player receives, both positively and negatively, are derived from the five major categories 14, 16, 20, 21, 22 or the bonus and sky areas disposed about the playing surface 12. For example, if a player answers the posed question correctly and the state quester 18 resides over major category 14 (state archives-30) the player would receive a positive point award of 30 points to be added to his score sheet. The converse is also true. If the player answers the posed question incorrectly 30 points are deducted from the total of the player's total score.

Additional points may be awarded to a player if that player, by the spinning of the state quester 18, is within any one of the bonus areas disposed about the playing surface 12. The player may now chose any one of the major categories for answering the posed question. If the player answers the posed question correctly, the bonus score is added to the player's total score. If the player answers the posed question incorrectly, the bonus score amount is deducted from that player's total score.

A player loses all points if the player, by the spinning of the state quester 18, is within anyone of the sky areas. If the player is within the sky penalty area all accumulated points of that particular player are withdrawn or set to zero.

This process of spinning the state quester 18, answering questions, and recording the resulting score continues until one of the players receives a total point score of one hundred or the timer 42 expends the allotted time. If none of the players has received a total score of one hundred by the end of the allotted time period, the announcer reviews the total score of all of the players. The announcer then indicates which player has received the highest accumulated score and that player wins the game.

Although only a few exemplary embodiments of this invention have been described in detail above, those skilled in the art will readily appreciate that many modifications are possible in the exemplary embodiments without materially departing from the novel teachings and advantages of this invention. Accordingly, all such modifications are intended to be included within the scope of this invention as defined in the following claims, means-plus-function clause is intended to cover the structures described herein as performing the recited function and not only structural equivalents but also equivalent structures. Thus, although a nail and a screw may not be structural equivalents in that a nail employs a cylindrical surface to secure wooden parts together, whereas a screw employs a helical surface, in the environment of fastening wooden parts, a nail and a screw may be equivalent structures.

I claim:

1. An educational game having players assembled about the game, comprising:

a) a plurality of question and answer cards, said question and answer cards having a selected color;

b) a circular game board having center point, said circular game board having disposed thereon five major question categories color coordinated with said question and answer cards;

c) an elongated dial member operatively disposed to said center point of said circular game board;

d) said dial member receiving a rotative spin, said dial member by coming to rest selects one said major question category;

e) a bell adjacently disposed to the educational game, said bell being rung after said dial member has come to rest indicating a selected player from the assembled players being prepared to answer a posed question; and f) said selected major category indicative of a question drawn from said plurality of question and answer cards and posed to said selected player.

2. An educational game recited in claim 1 further comprising an award and penalty area disposed intermediate each said major category.

3. An educational game recited in claim 2 further comprising a timer adjacently disposed to said game board, said timer tracking the playing time of the game.

4. An educational game recited in claim 3 wherein said playing surface having disposed thereon the name of a state in the United States.

5. An educational game recited in claim 4 wherein, said major question categories represent attributes of said named state.

6. An educational game recited in claim 5 wherein, said state attributes are selected from a group consisting of natural history, famous people, state archives, cites, counties, and tourist attractions.

7. A method for playing an educational board game having players assembled about the game, comprising the steps of:

a) providing a circular game board having a top surface, said game board top surface having operatively disposed thereon an elongated dial member, said game board having adjacently disposed thereto a plurality of question and answer cards;

b) said game board having disposed thereon five major categories;

c) selecting one of the players to begin the game;

d) spinning said elongated dial member by said selected player;

e) selecting one said major category by said elongated dial member coming to rest;

f) providing a bell to be rung by a selected player indicating said elongated dial member is at rest and they are ready to answer a posed question;

g) selecting a card from said plurality of question and answer cards corresponding to said indicated major question category;

h) posing a question to said selected player, said question being derived from said selected question and answer card;

i) answering said posed question;

j) awarding a selected value derived from a provided award or penalty area to said selected player who was the first to ring said bell and correctly answer said posed question; and k) penalizing said player for incorrectly answering said posed question.

* * * * *